US010982485B2

(12) United States Patent
Natrajan et al.

(10) Patent No.: US 10,982,485 B2
(45) Date of Patent: Apr. 20, 2021

(54) INSTALLATION SYSTEM FOR FABRICATING MULTIPLE GLAZING UNITS AND METHOD THEREOF

(71) Applicant: SAINT-GOBAIN GLASS FRANCE, Courbevoie (FR)

(72) Inventors: Vinay Natrajan, Tamil Nadu (IN); Sasi Kiran Tallam, Andhra Pradesh (IN)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 47 days.

(21) Appl. No.: 16/670,054

(22) Filed: Oct. 31, 2019

(65) Prior Publication Data

US 2020/0141178 A1 May 7, 2020

(30) Foreign Application Priority Data

Nov. 2, 2018 (IN) ..... 201841041626

(51) Int. Cl.

| | |
|---|---|
| ***E06B 3/67*** | (2006.01) |
| ***B05C 5/02*** | (2006.01) |
| ***E06B 3/66*** | (2006.01) |
| ***E06B 3/673*** | (2006.01) |
| ***E06B 3/663*** | (2006.01) |

(52) U.S. Cl.

CPC ..... *E06B 3/67321* (2013.01); *B05C 5/0212* (2013.01); *E06B 3/66342* (2013.01)

(58) Field of Classification Search

USPC ..... 52/786.13

See application file for complete search history.

(56) References Cited

U.S. PATENT DOCUMENTS

| | | | | |
|---|---|---|---|---|
| 10,350,625 | B2 * | 7/2019 | Mader | B05C 5/0204 |
| 2005/0167028 | A1 * | 8/2005 | Reichert | E06B 3/66352 156/109 |
| 2005/0217310 | A1 * | 10/2005 | Luehrs | F25D 23/065 62/441 |
| 2006/0027260 | A1 * | 2/2006 | LeCompte | C09K 9/00 136/243 |
| 2009/0272483 | A1 * | 11/2009 | Howes | B32B 17/10 156/109 |
| 2014/0290156 | A1 * | 10/2014 | Bruce | E06B 3/66366 52/171.3 |
| 2016/0265265 | A1 * | 9/2016 | Merlo | E06B 3/67391 |
| 2017/0268285 | A1 * | 9/2017 | Abe | E06B 3/677 |

FOREIGN PATENT DOCUMENTS

| | | | | |
|---|---|---|---|---|
| EP | 2719533 | A1 * | 4/2014 | E06B 3/6621 |
| IN | 5167/CHE/2015 | | 12/2016 | |

* cited by examiner

*Primary Examiner* — Brian D Mattei
*Assistant Examiner* — Jeanette E Chapman
(74) *Attorney, Agent, or Firm* — Pillsbury Winthrop Shaw Pittman LLP

(57) ABSTRACT

An installation system to fabricate the multiple glazing units at the installation site is provided. The installation system includes a primary glazing unit, a secondary glazing unit, a spacer element, a primary sealant, a fixture, a secondary sealant and a dispenser. The installation system includes a fixture to apply the primary sealant on the spacer element. The installation system also includes a dispenser to apply the secondary sealant to a clearance between the primary glazing unit and the secondary glazing unit.

22 Claims, 11 Drawing Sheets

INSTALLATION SYSTEM FOR FABRICATING MULTIPLE GLAZING UNITS AND METHOD THEREOF

CROSS-REFERENCE TO RELATED APPLICATIONS

This application claims priority to Indian Patent Application No. 201841041626, filed Nov. 2, 2018, the entire content of which is incorporated herein by reference in its entirety.

FIELD

The present disclosure relates in general to glazing units of a building and, in particular to a system and method for retro-fitting glazing units.

BACKGROUND

In many buildings, single glazing units have been installed. However, such single glazing units may not provide effective cooling or heating, thereby increasing costs for cooling and/or heating devices within the building. Further, such single glazing units also may not provide acoustic comfort thereby causing noise pollution, particularly in buildings near high streets, urban traffic, motorways, train stations and airports.

Conversely, in some buildings, the insulated glazing units such as double glazing unit or triple glazing unit that have been already installed are sometimes damaged by external forces and need to be replaced. For instance, after the lifetime of a sealant used for sealing the glazing units in the window frames, the sealant may start deteriorating which can result in damage to the insulated glazing unit.

In all, replacing the existing glazing or installing fresh multiple glazing units in the above-mentioned scenarios may incur high labor and material costs.

The methods for adding an additional glazing unit to an existing glazing unit or installing fresh multiple glazing units are available. These methods include adding the glazing unit from outside that requires setting up complex scaffoldings. Other methods include adding the glazing unit directly to the frame. Such methods may not provide an effective shield against moisture which can still leak in thereby increasing the chances of condensation or provide better insulation or acoustic comfort. In other cases, specially designed glazing units, spacers or other components may be used for converting the existing glazing units to multiple glazing units. However, the use of these new components may incur production and/or manufacturing costs.

For reference, Indian patent publication 5167/CHE/2015 from the same applicant ("patent application '5167") discloses a method and system of converting an installed glazing unit to a multiple glazing units at an installation site. The method and system include an installed glazing unit, secondary glazing unit, a spacer and a sealant applicator which fills a sealant in a clearance between two glazing units that are attached to each other. The sealant applicator includes a thicker end, which defines a central hole to receive the sealant and a thinner end which defines an elongated channel in fluid communication with the central hole. The thinner end is configured to dispense the fluid in the clearance between the two glazing units. Although the applicator efficiently fills the clearance with the sealant. The wastage of unused sealant in the thinner end is unavoidable.

Moreover, a higher pressure intensity will be required to maintain the flow rate of the sealant in the applicator as per the above mentioned patent application '5167. However, manually applying such higher pressure for a longer duration will be tedious and exhausting for the operator. The patent application '5167 further failed to provide a proper fixing mechanism for attaching the sealant applicator to the cartridges resulting in detachment of applicator from the cartridges. Besides this, the applicator disclosed in this patent application '5167 does not provide a mechanism to create a finishing and smoothening the sealant.

Currently there are no tools available in the market place for applying a primary sealant to the spacer element for attaching the glazing units at installation sites. During this application process, there is a high probability of application mismatch with the spacer element edges which results in primary sealant protruding or purging out and visible between the glazing units. The above scenario occurs when there is no sufficient gap from the primary sealant edge to spacer element edge.

Thus, the intended objective of the present disclosure is to design a fixture and a new dispenser that can solve the drawbacks such as sealant leakage, wastage, discontinuous bead formations of the sealant, sealant purging while also being operator friendly during installations.

SUMMARY

In one aspect of the present disclosure, an installation system for fabricating the multiple glazing units at the installation site is provided. The installation system includes a primary glazing unit, a secondary glazing unit, a spacer element, a primary sealant, a fixture, a secondary sealant and a dispenser. The spacer element keeps the primary and secondary glazing unit apart. The spacer element aligned there between at the periphery of the primary and the secondary glazing unit. The spacer element comprises of a first surface and a second surface. The second surface is opposite to the first surface. The first surface is configured to be attached to the primary glazing unit and the second surface is configured to be attached to the secondary glazing unit. The installation system also includes the fixture which helps to apply the primary sealant simultaneously on the first surface and the second surface of the spacer element. The installation system also includes a dispenser to apply the secondary sealant to a clearance between the primary glazing unit and the secondary glazing unit.

In yet another aspect of the present disclosure, a method to fabricate multiple glazing units at the installation site is provided. The method includes, providing at least a primary glazing unit, at least a secondary glazing unit and a spacer element. The spacer element has a first surface and a second surface. The second surface is opposite to the first surface. The method also includes applying a primary sealant simultaneously on the first surface and the second surface of the spacer element using a fixture. The method also includes attaching the first surface of the spacer element to the primary glazing unit and the second surface of the spacer element to the secondary glazing unit. The method further includes aligning the primary glazing unit in a substantially parallel relationship to the secondary glazing unit with the spacer element disposed there between at the periphery of the primary and the secondary glazing unit. The method furthermore includes filling a secondary sealant in a clearance between the primary glazing unit and the secondary glazing unit to adjoin the secondary glazing unit and the primary glazing unit to using a dispenser.

In yet another aspect of the present disclosure, the fixture to apply the primary sealant simultaneously on the first surface and the second surface of the spacer element is provided. The fixture comprises of an upper surface and a lower surface. The upper surface is opposite to the lower surface. The upper surface is coated with a hydrophobic material. The lower surface is flat. The upper surface defines a cavity channel to receive and maintain spacer element in a desired position for the application of primary sealant.

In yet another aspect of the present disclosure, the dispenser to apply the secondary sealant to the clearance between the primary glazing unit and the secondary glazing unit is provided. The dispenser comprises of a hollow tubular member comprising of a proximal end and a distal end. The proximal end is opposite to the distal end. The proximal end defined the first hole and an attachment member. The distal end defines a second hole and a pair of wings. The attachment member is configured to attach to a nozzle of the sealant containing cartridge. The first hole receives the secondary sealant and the second hole dispenses out the secondary sealant to adjoin the primary and secondary glazing unit. The pair of wings finishes and smoothens the secondary sealant in the clearance between the primary glazing unit and secondary glazing unit.

Other features and aspects of this disclosure will be apparent from the following description and the accompanying drawings.

BRIEF DESCRIPTION OF THE DRAWINGS

Embodiments are illustrated by way of examples, and are not limited to the accompanying figures.

Skilled artisans appreciate that elements in the figures are illustrated for simplicity and clarity and have not necessarily been drawn to scale. For example, the dimensions of some elements in the figures may be exaggerated relative to other elements to help to improve the understanding of embodiments of the disclosure.

DETAILED DESCRIPTION

Figure 1:
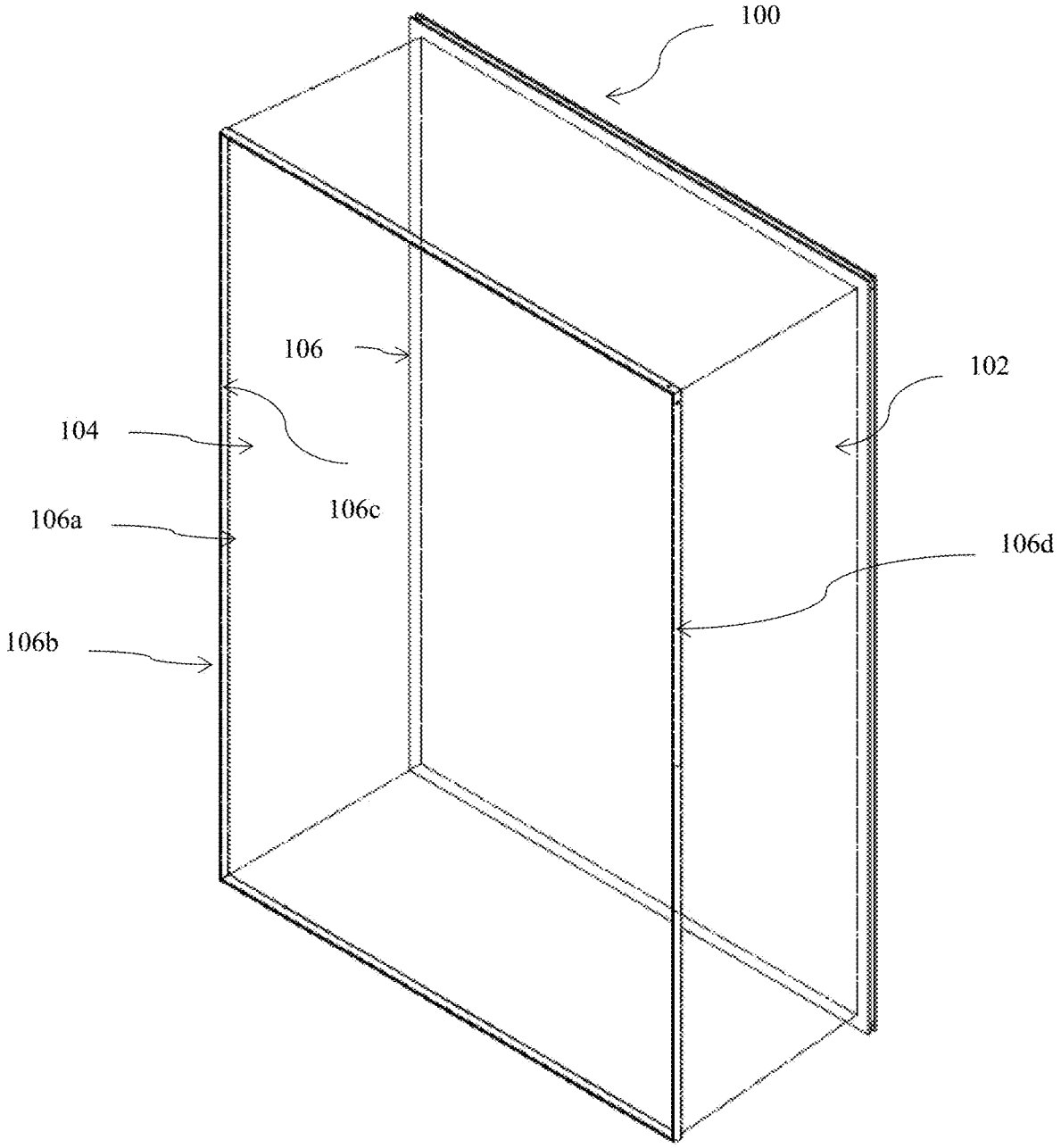
FIG. 1 illustrates an exploded view of an installation system to fabricate multiple glazing units, according to an embodiment of the present disclosure.
Figure 2:
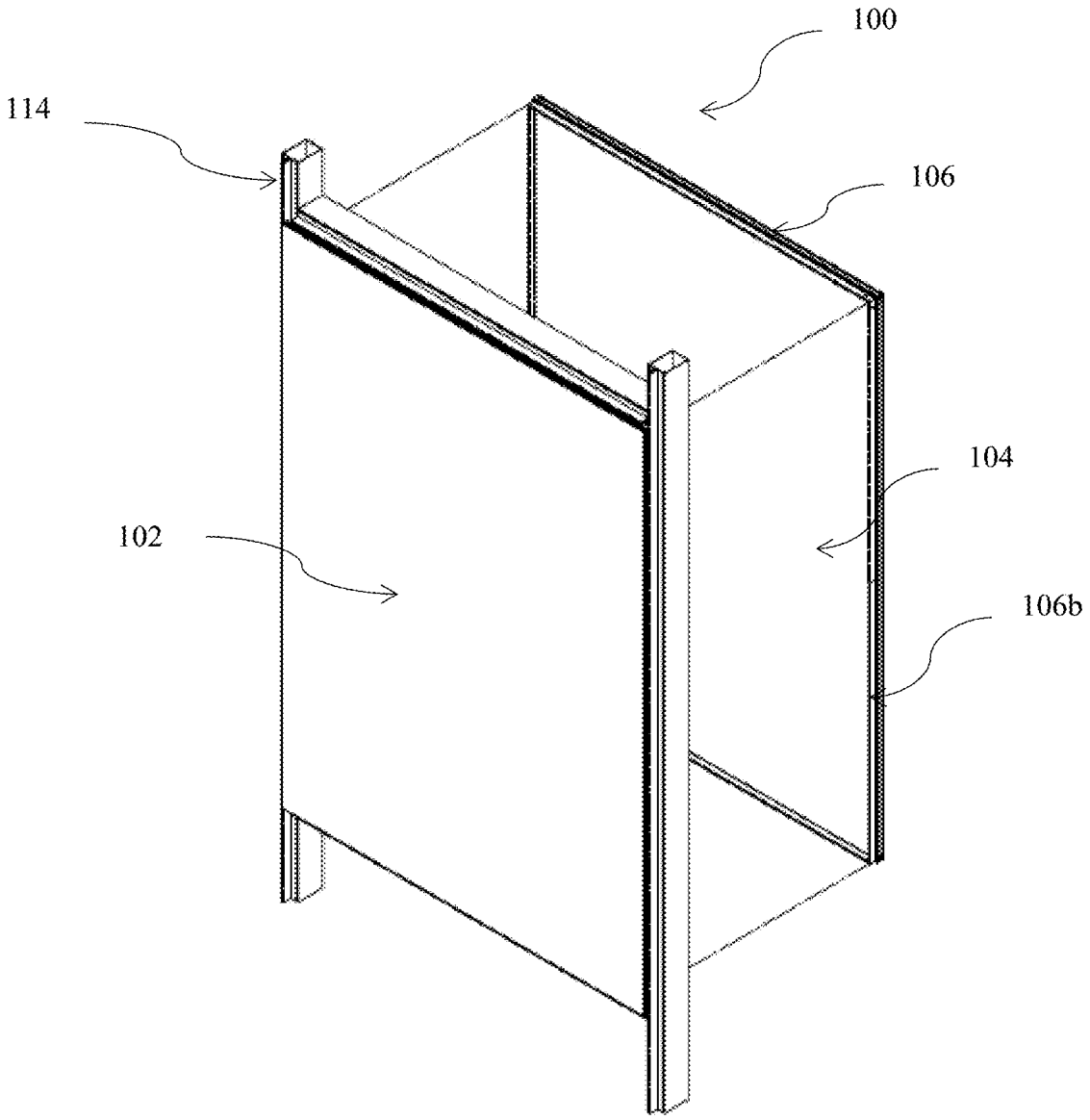
FIG. 2 illustrates a partially exploded view of the multiple glazing units, according to an embodiment of the present disclosure.

Wherever possible, the same reference numbers are used throughout the drawings to refer to the same or the like parts. FIGS. 1 and 2 illustrate an installation system 100 to fabricate the multiple glazing units at an installation site, according to an embodiment of the present disclosure. The installation site may refer to a site where either fresh multiple glazing unit is fabricated due to damage by external forces as shown in FIG. 1 or to convert an already installed glazing unit into multiple glazing units as shown in FIG. 2. The installation system 100 comprises of at least a primary glazing unit 102, at least a secondary glazing unit 104 and a spacer element 106. In various other examples, the primary 102 and the secondary glazing units 104 may be a double glazing unit, single glazing unit or triple glazing unit. In another example, the primary glazing unit 102 may be already attached to the window frame 114 which is installed on the wall structure of the building as shown in FIG. 2. The primary glazing unit 102 and the secondary glazing unit 104 are together configured to form the multiple glazing unit. The spacer element 106 has a rectangular shape. In an example, the spacer element 106 may be made of aluminum. In various other examples, the spacer element 106 may be made of polycarbonate based composites, metals and the like. In an embodiment, the spacer element 106 may be formed by bending an elongated strip of the suitable material to a required shape. Suitable bending tools may be employed to bend the elongated strip to form the spacer element 106. In other embodiments, multiple strips may be suitably joined to form the spacer element 106. The spacer element 106 has a first surface 106*a* and a second surface 106*b*. The second surface 106*b* is opposite to the first surface 106*a*. The spacer element 106 also includes an inner surface 106*c* and an outer surface 106*d*. The first surface 106*a* is configured to be attached to a side of the primary glazing unit 102. The second surface 106*b* is configured to be attached to a side of the secondary glazing unit 104.

Figure 3:
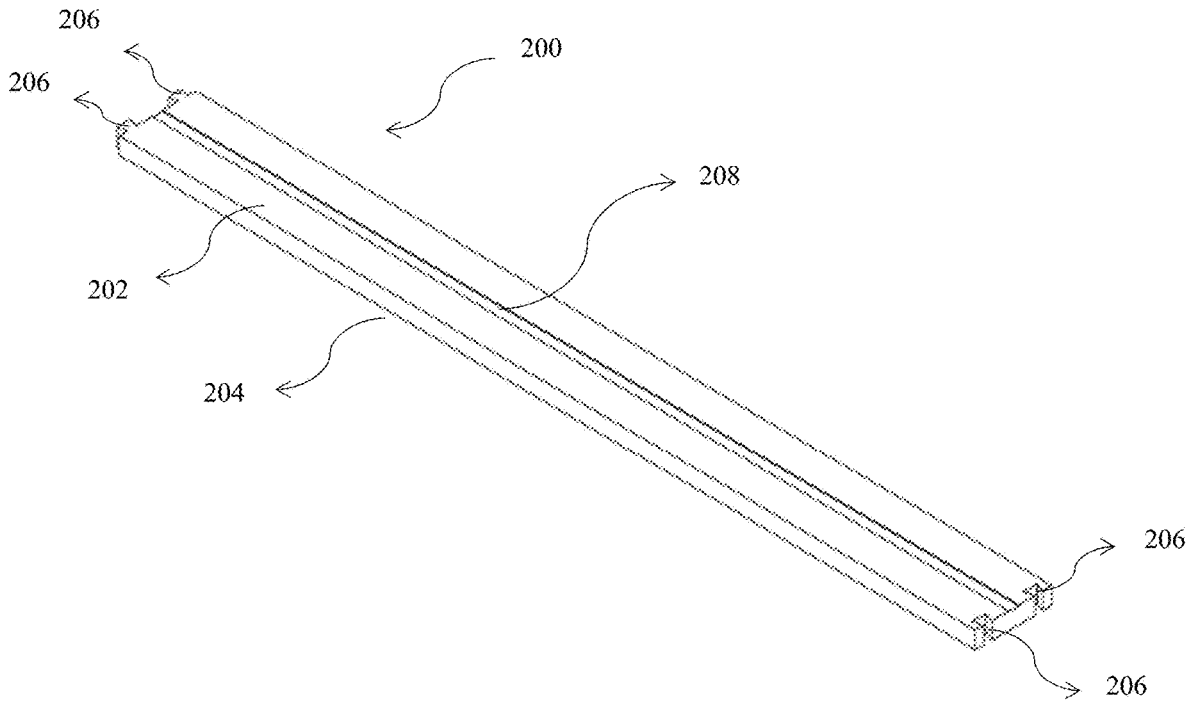
FIG. 3 illustrates a perspective view of a fixture of the installation system, according to an embodiment of the present disclosure.
Figure 4:
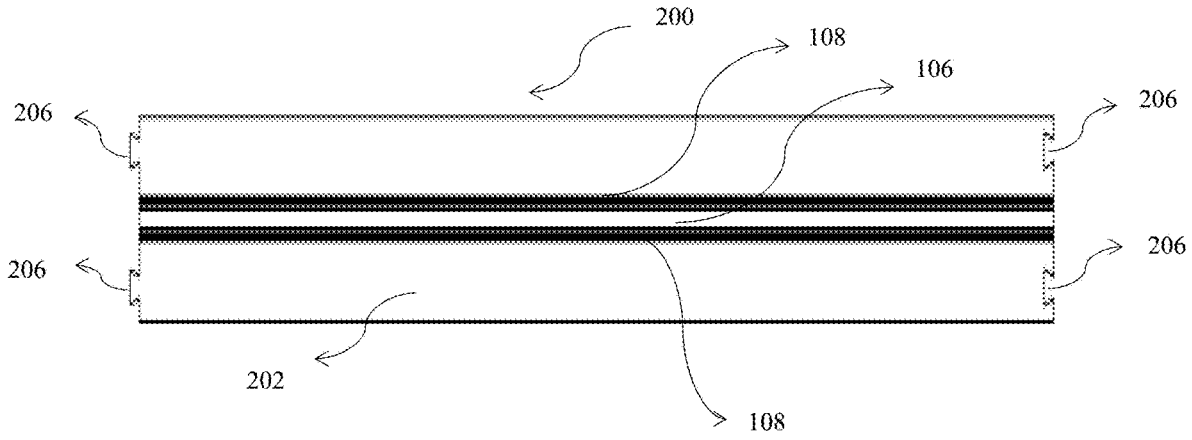
FIG. 4 illustrates a partial perspective view of the installation system showing a fixture being used to apply a primary sealant thereon, according to an embodiment of the present disclosure.

In one embodiment, the installation system 100 includes a fixture 200 to apply the primary sealant 108 simultaneously to the first surface 106*a* and the second surface 106*b* of the spacer element 106. The spacer element 106 is attached to the primary glazing unit 102 and/or secondary glazing unit 104 using primary sealant 108. Referring to FIGS. 3 and 4, the fixture 200 of the installation system 100 is provided. The fixture 200 comprises of an upper surface 202 and a lower surface 204. The upper surface 202 is opposite to the lower surface 204. The lower surface 204 is flat. The upper surface 202 is coated with a hydrophobic material. The hydrophobic material includes one of the silicon oil, grease, wax, machine oil. The upper surface 202 defined a cavity channel 208 to receive and maintain the desired position of the spacer element 106 and the primary sealant 108. The depth of the cavity channel 208 is designed in such a way that the depth is not greater than the width of the spacer. This will help to avoid the protrusion of the primary sealant 108 when the multiple glazing units are fabricated.

The primary sealant 108 is applied simultaneously to the first surface 106*a* and the second surface 106*b* of the spacer element 106 using a fixture 200 without removing the spacer element 106 from the cavity channel 208. The fixture 200 also comprises of a pair of dovetail joints 206 at both edges of the fixture 200. The fixture 200 is made up of metal such as stainless steel or plastics such as nylon. The fixture 200 can be fixed to a work station such as a table using screws.

Figure 5:
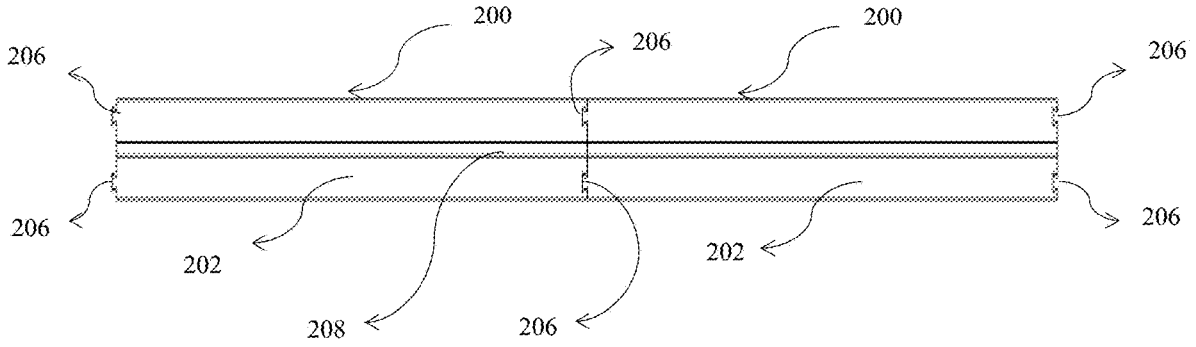
FIG. 5 illustrates a perspective view of a lengthened fixture of the installation system, according to an embodiment of the present disclosure.

In an example, the length of the fixture 200 is equal to the length of the spacer element 106 as shown in FIG. 4. In another example, the length of the spacer is more than the length of the fixture 200. In an embodiment, the fixture 200 can be lengthened to accommodate longer spacer element 106 as shown in FIG. 5 by adding an additional fixture 200 by engaging the pair of dovetail joints 206 of one fixture 200 to the pair of dovetail joints 206 of another fixture 200. Thus, the fixture 200 is designed to assist application of primary sealant 108 to diverse length of spacer element 106.

The primary sealant 108 is an adhesive which is based on an acrylic foam material, a butyl coated poly-vinyl chloride or poly-isobutyl. The primary sealant 108 may be a tape. In such a case, the primary sealant 108 may be attached to each of the first surface 106*a* and the second surface 106*b* of the spacer element 106 by removing a liner of the tape. Further, a liner on other side of each of the tapes may be removed for attaching the spacer element 106 to the respective primary glazing unit 102 and the secondary glazing unit 104.

In an embodiment, a moisture barrier (not shown) may be disposed at least on the outer surface 106*d* of the spacer element 106. In an example, the moisture barrier may be an aluminum foil. The moisture barrier may be configured to restrict the moisture from passing there through. Moreover, the moisture barrier may also be used to cover any joints on the spacer element 106. As such, the moisture barrier may restrict the moisture from entering through the joints of the spacer element 106.

In an embodiment, the inner surface 106*c* of the spacer element 106 may define one or more micro-holes therein. In an embodiment, the spacer element 106 may contain a hygroscopic material therein. In one example, the hygroscopic material may be a desiccant such as a silicon material. The hygroscopic material may be provided to dry up the moisture entering the spacer element 106 through the micro-holes.

Figure 6:
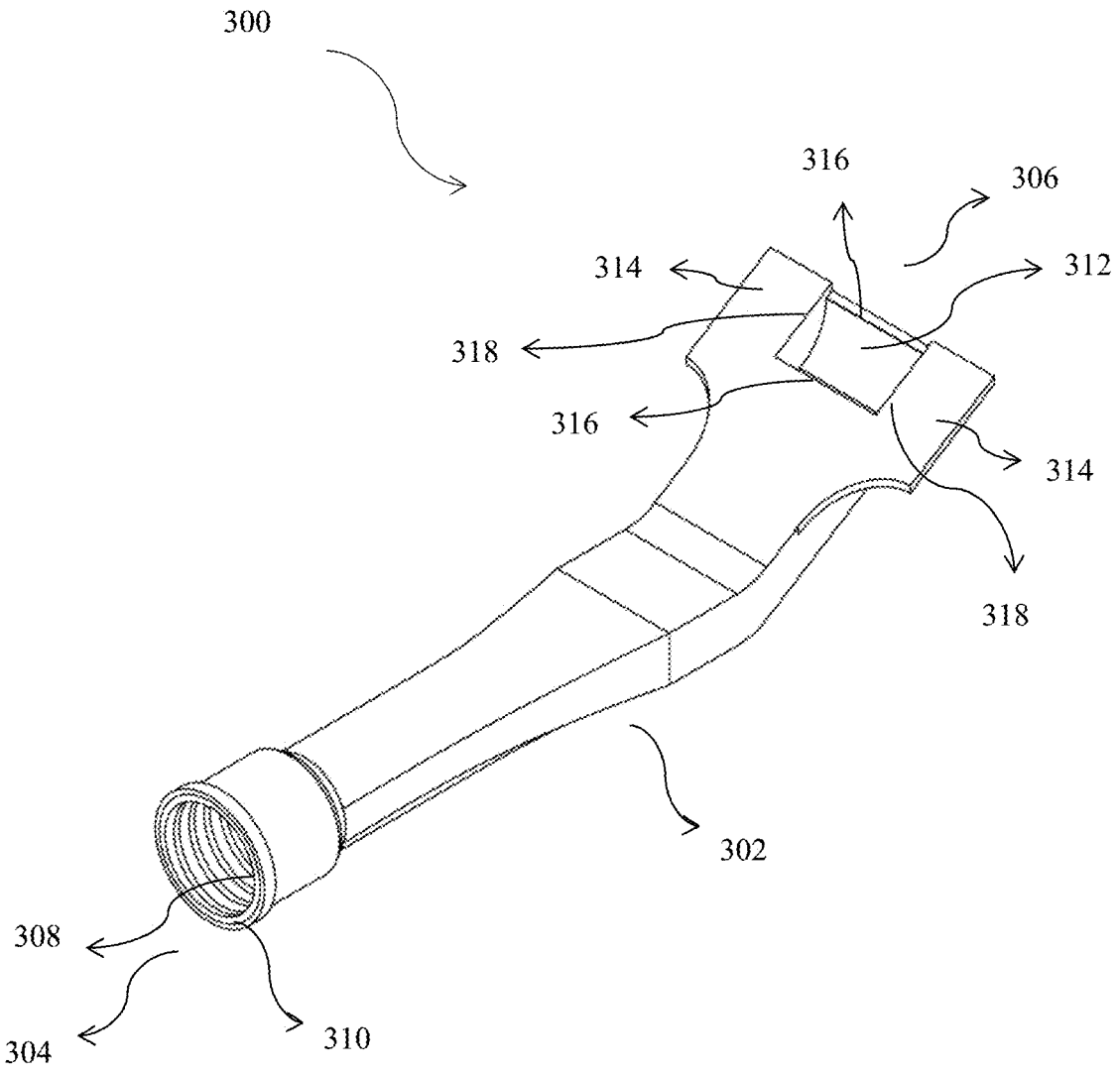
FIG. 6 illustrates a perspective view of a dispenser of the installation system, according to an embodiment of the present disclosure.
Figure 7:
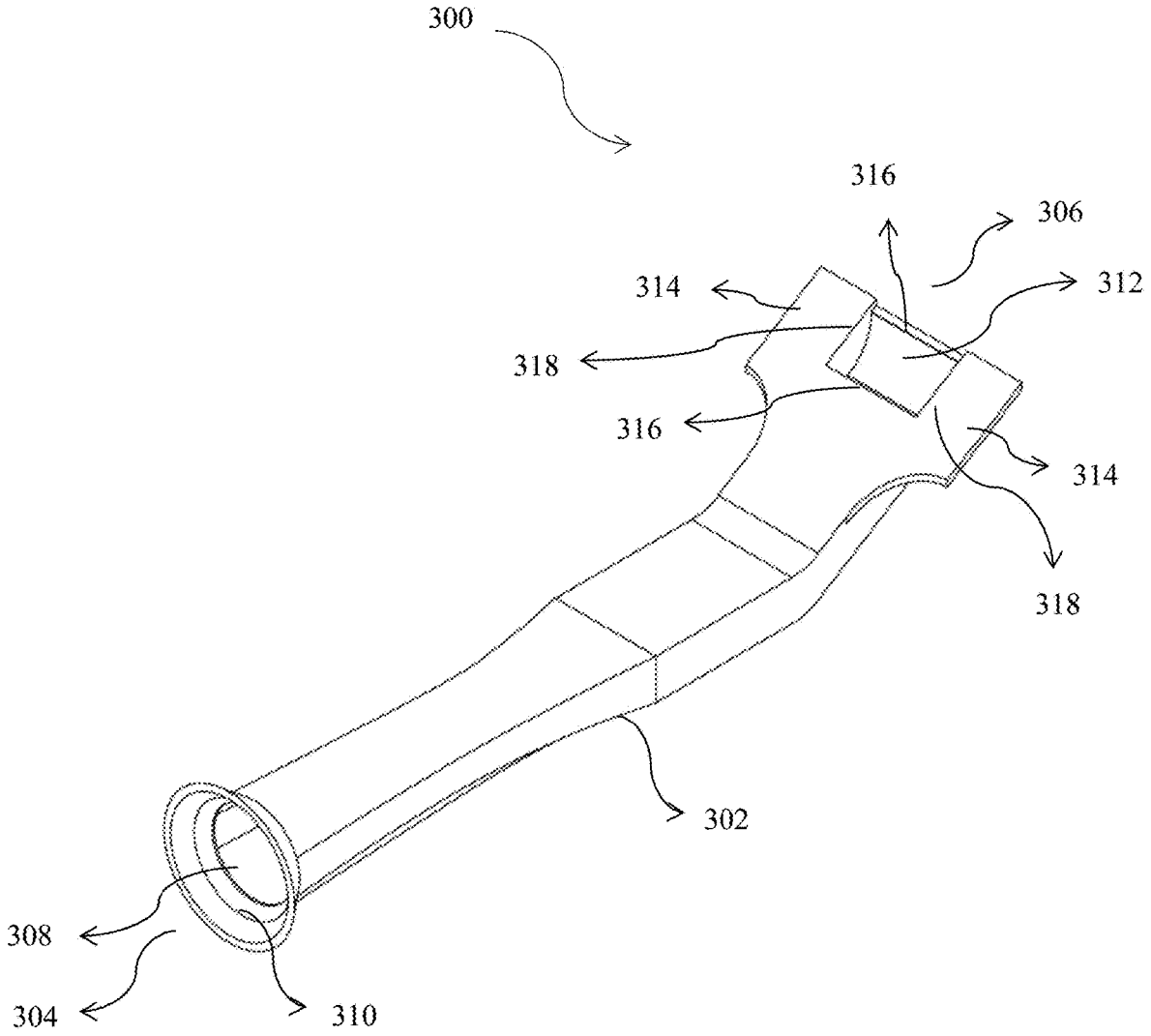
FIG. 7 illustrates a perspective view of a dispenser of the installation system, according to another embodiment of the present disclosure.

The dispenser 300 as shown in FIGS. 6 & 7 includes a hollow tubular member 302 having a proximal end 304 to receive the secondary sealant 110 and the distal end 306 to dispense the secondary sealant 110. The distal end 306 is opposite the proximal end 304. The proximal end 304 comprises of the first hole 308 and an attachment member 310. The distal end 306 comprises of the second hole 312. An internal passageway is formed by the hollow tubular member 302 and connects the proximal end 304 and the distal end 306. The first hole 308 receives the secondary sealant 110 and the second hole 312 dispenses the secondary sealant 110. The hollow tubular member 302 generally tapers from a relatively large volume inlet at the proximal end 304 to a generally small volume outlet at the distal end 306. Consequently, the hollow tubular member 302 of a defined length has a cross-section which increases in the cross-sectional area from the proximal end 304 to the distal end 306. The hollow tubular member 302 cross-section varies from a circular cross-section at the proximal end 304 to a rectangular cross-section at the distal end 306.

The change of cross-section of the hollow tubular member 302 from circular to rectangular is gradual. Therefore, the secondary sealant 110 enters the proximal end 304 where the cross-section is more. At this point the volume is increased and the pressure intensity reduces. Subsequently, the secondary sealant 110 is extruded via the dispenser 300 opening at the distal end 306, where gradually the cross-section reduces, so the volume of the secondary sealant 110 reduces and the pressure intensity is increased. Due to the gradual pressure change, there is no pressure loss. As a result, the secondary sealant 110 in the dispenser 300 does not flow back. Further, as the pressure intensity is high at the distal end 306, the flow rate is also high. Accordingly, the secondary sealant 110 will drip from the dispenser 300 continuously. Thus, this design configuration of the dispenser 300 helps to pressurize the secondary sealant 110 so that an even stream or bead of secondary sealant 110 is emitted from the second hole 312 at the distal end 306. Therefore, there is no leakage or wastage of the secondary sealant 110. Moreover, as higher pressure intensity is provided at the distal end 306, the flow rate of the secondary sealant 110 stabilizes. Hence, there is no need to apply manually higher manual pressure to push the secondary sealant 110 out from the cartridge 400. This makes the task of the operator effortless and simple.

The dispenser 300 is provided with the attachment member 310. The attachment member 310 is either a threaded attachment member 310 (as shown in FIG. 6) or snap fitted attachment member 310 (as shown in FIG. 7). The dispenser 300 which has a threaded attachment member 310 is provided to threadedly engage the first hole 308 of the proximal end 304 to the nozzle 402 of the secondary sealant 110 containing cartridge 400. Likewise, the dispenser 300 which has a snap fitted attachment member 310 is provided to snap fittingly engage the first hole 308 of the proximal end 304 to the nozzle 402 of the secondary sealant 110 containing cartridge 400. The attachment member 310 captures and retains the dispenser 300 and the cartridge 400 together. This ensures that the dispenser 300 is not detached from the cartridge 400.

Referring now to FIGS. 6 to 9, the primary glazing unit 102, the secondary glazing unit 104 and the outer surface 106*d* of the spacer element 106 also defines a clearance 112 thereabout. Specifically, the clearance 112 may be defined between the outer surface 106*d* of the spacer element 106, the primary glazing unit 102, and the secondary glazing unit 104. The clearance 112 is filled with the secondary sealant 110 to bond the primary glazing unit 102 and the secondary glazing unit 104 to each other.

The dispenser 300 is further provided with at least two wings 314 located at the distal end 306 which is constructed and arranged for tooling the secondary sealant 110 that dispenses out in the clearance 112 via the internal passageway from the second hole 312 of the distal end 306. In an embodiment, the pair of wings 314 projects laterally from the hollow tubular member 302 at the second hole 312 of the distal end 306. The wings 314 are integrally molded with the dispenser 300. The wings 314 are constructed and arranged to be relatively stiff to be able to tool the secondary sealant 110. Another feature of the wing 314 is that it defines a restricted outlet for the secondary sealant 110 as the dispenser 300 is dragged along the clearance 112 between the primary glazing unit 102 and the secondary glazing unit 104. Thus, the secondary sealant 110 is emitted from the dispenser 300 from the second hole 312 of the distal end 306 and the flow is restricted by the wings 314. The wings 314 are flat and rectangular in shape.

The second hole 312 of the distal end 306 is defined by a pair of parallel long edges 316, and a pair of parallel short edges 318 that together define a rectangular shape. The wings 314 open out in a plane parallel to an adjacent one of the short edges 318.

The dispenser 300 applies the secondary sealant 110 in the clearance 112 between the primary glazing unit 102 and the secondary glazing unit 104. The dispenser 300 is capable of dispensing the secondary sealant 110 in a uniform and consistent manner between the primary glazing unit 102 and the secondary glazing unit 104 as described in greater detail below. In an embodiment, the dispenser 300 of the present disclosure can be used in conjugation with cartridge 400.

The dispenser 300 is designed in such a way that the it can readily slide along the clearance 112 between the primary glazing unit 102 and the secondary glazing unit 104. In addition, because of the design of the distal end 306, it can be used to enable easy access to the clearance 112.

It will be appreciated that a dispenser 300 of the present disclosure could be used to apply a wide variety of materials to a wide variety of substrates. The dispenser 300 is used to apply materials, but not limited to sealant, adhesive, silicone or grout. The dispenser 300 is made of durable material, but not limited to metal, plastic, polyethylene terephthalate (PET), nylon, polycarbonate, polypropylene or acrylonitrile styrene acrylate.

Figure 8:
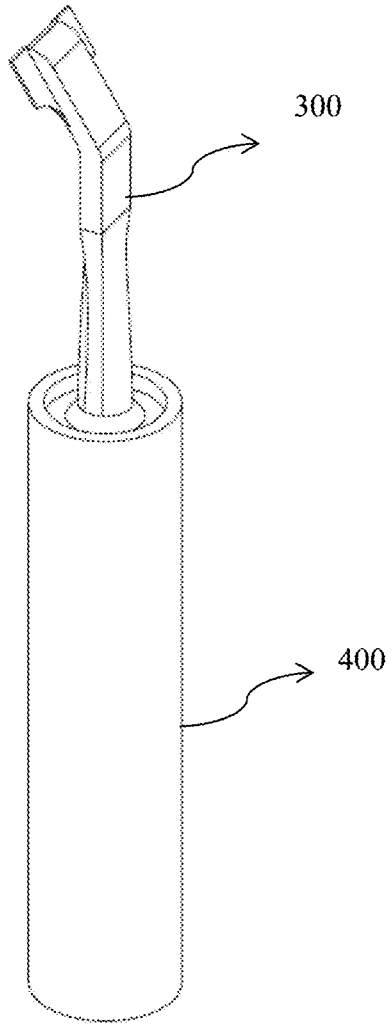
FIG. 8 illustrates a perspective view of a dispenser attached to a nozzle of the sealant containing cartridge, including the dispenser, according to an embodiment of the present disclosure.

FIG. 8 illustrates dispenser 300 coupled to a cartridge 400 to facilitate dispensing the secondary sealant 110. The cartridge 400 is in fluid communication with the disperser 300. The cartridge 400 has to be pressed manually or automatically to dispense the secondary sealant 110. The device used for automatic dispensing of the secondary sealant 110 comprises of a pump to supply the secondary sealant 110 to the dispenser 300. The cartridge 400 can generate secondary sealant 110 flow through the second hole 312 of the distal end 306 of the dispenser 300.

Figure 9A:
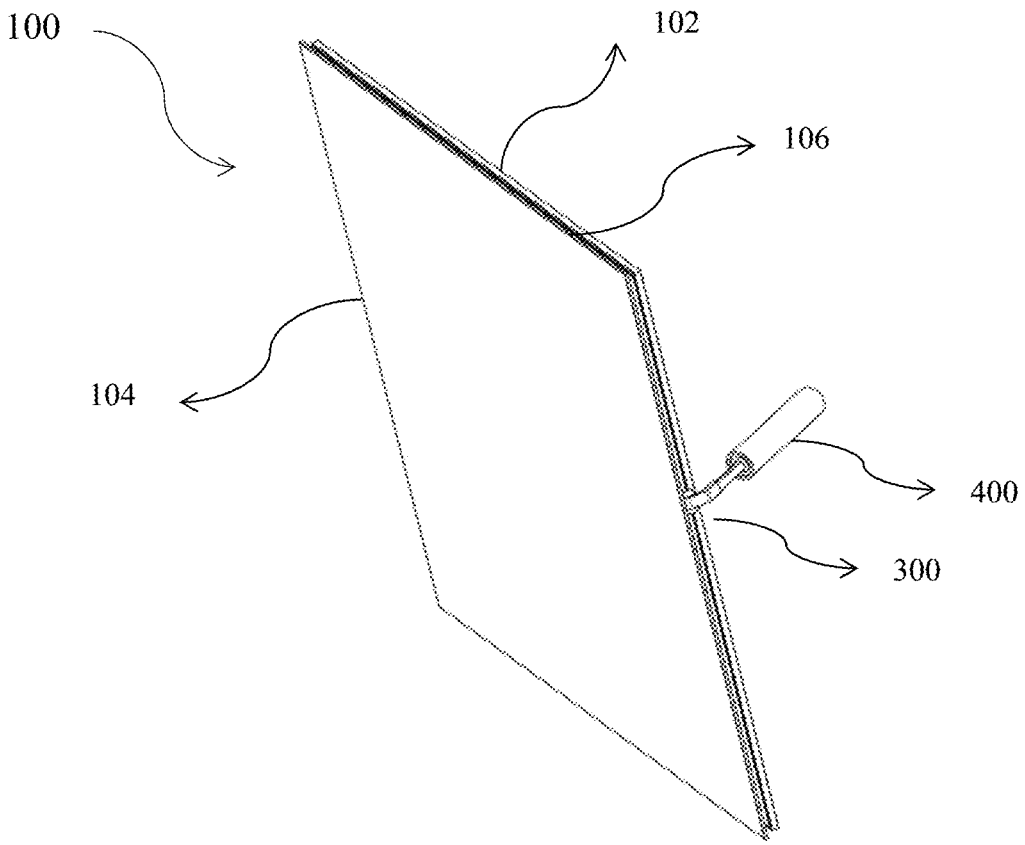
FIGS. 9A and 9B illustrate a partial perspective view of the installation system showing a dispenser being used to apply a secondary sealant thereon, according to an embodiment of the present disclosure.
Figure 9B:
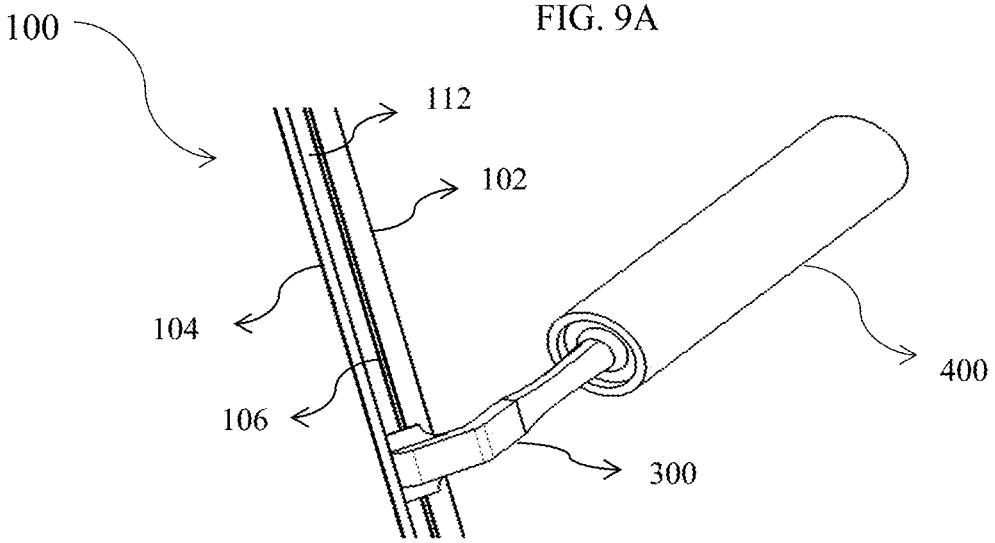

FIGS. 9A and 9B illustrates a perspective view of the primary glazing unit 102, the secondary glazing unit 104 and a portion of the dispenser 300, wherein the distal end 306 of the dispenser 300 is positioned to dispense the secondary sealant 110 onto the clearance 112.

The secondary sealant 110 may extend all the way around the perimeter of the clearance 112 between the primary glazing unit 102 and the secondary glazing unit 104. In the dispenser 300, the distal end 306 of the dispenser 300 is used to apply secondary sealant 110. The dispenser 300 is moved around the perimeter of the clearance 112 and dispenses the secondary sealant 110 between the clearance 112 provided between the primary glazing unit 102 and the secondary glazing unit 104. The secondary sealant 110 extends continuously and covers the outer face 106*d* of the spacer 106.

The dispenser 300 can seal the primary glazing unit 102 and the secondary glazing unit 104. The dispenser 300 can be designed to accommodate different ranges of clearance 112. The width of the secondary sealant 110 is changed by changing the width of the second hole 312 of the distal end 306. The width of the second hole 312 will depend on the clearance 112.

In an embodiment, the secondary sealant 110 may have a viscosity greater than or equal to 1300 centipoise. Further, the secondary sealant 110 may have a tensile strength greater than or equal to 1 MPa. In an embodiment, the secondary sealant 110 may be a silicone based adhesive. In an example, the secondary sealant 110 may be a transparent sealant. In other embodiments, other types of suitable secondary sealants 110 may be used to structurally bond the primary glazing unit 102 and secondary glazing units 104.

In an embodiment, an amount of the secondary sealant 110 used for attaching the primary 102 and secondary glazing units 104 may be selected based at least on a weight of the primary 102 and secondary glazing units 104 and various properties of the secondary sealant 110 being used. Accordingly, a volume of the clearance 112 defined between the primary 102 and secondary glazing units 104 may be varied.

Figure 10:
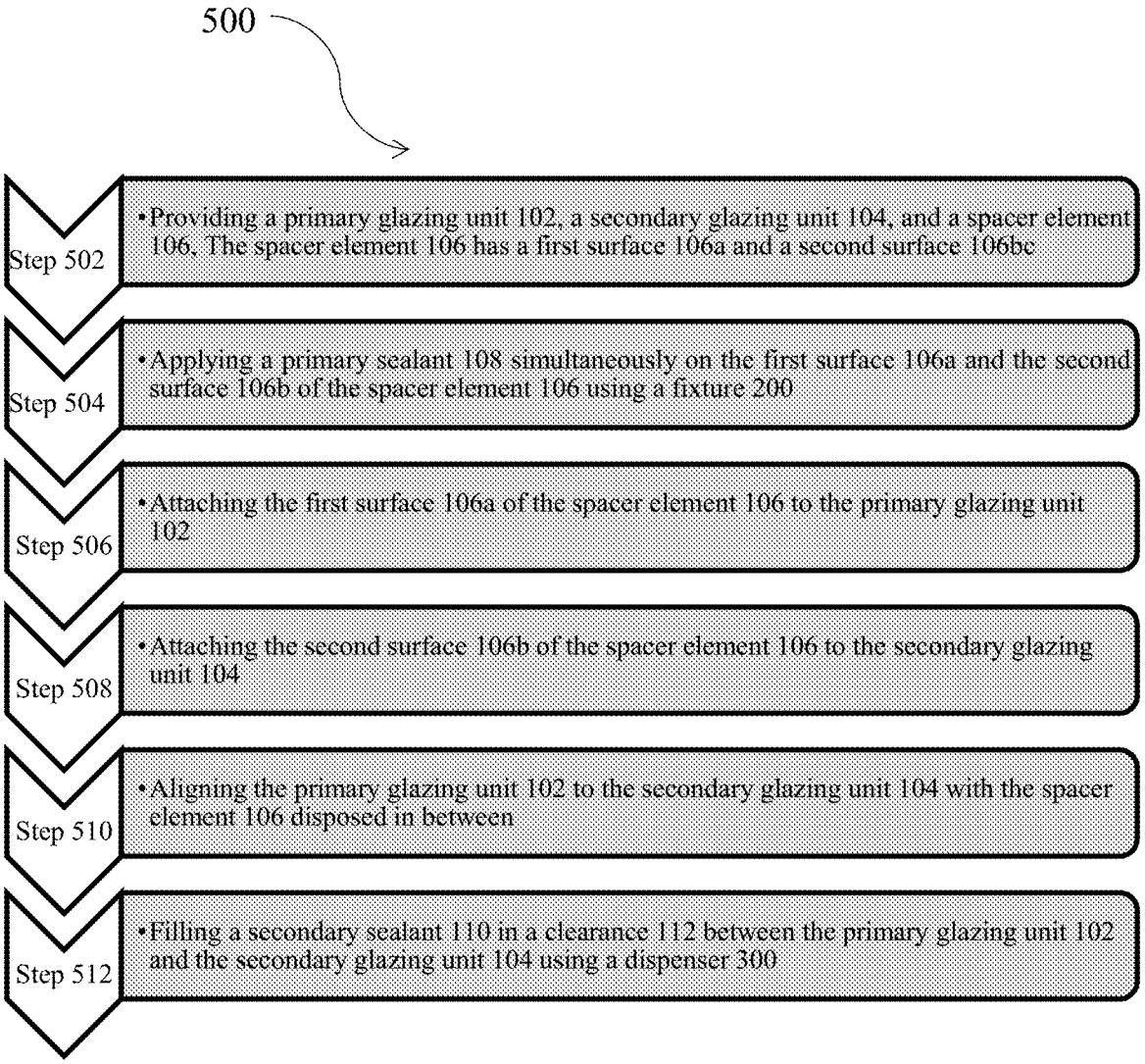
FIG. 10 illustrates a flowchart for a method to fabricate multiple glazing units, according to an embodiment of the present disclosure.

Referring to FIG. 10, a flowchart for a method 500 to fabricate the multiple glazing units as illustrated. However, it may also be contemplated to implement the method 500 with other suitable tools without deviating from the scope of the present disclosure and/or necessary modifications to the described components of the installation system 100.

At step 502, the method 500 includes providing at least a primary glazing unit 102, at least a secondary glazing unit 104, and a spacer element 106, wherein the spacer element 106 has a first surface 106*a* and a second surface 106*b*, the second surface 106*b* is opposite to the first surface 106*a*.

At step 504, the primary sealant 108 is simultaneously applied on the first surface 106*a* and the second surface 106*b* of the spacer element 106 using a fixture 200.

At step 506, the first surface 106*a* of the spacer element 106 is attached to the primary glazing unit 102.

At step 508, the second surface 106*b* of the spacer element 106 is attached to the secondary glazing unit 104.

At step 510, the primary glazing unit 102 is aligned in a substantially parallel relationship to the secondary glazing unit 104 with the spacer element 106 disposed there between at the periphery of the primary 102 and the secondary glazing units 104.

At step 512, a secondary sealant 110 is filled in a clearance 112 between the primary glazing unit 102 and the secondary glazing unit 104 to adjoin the secondary glazing unit 104 and the primary glazing unit 102 using a dispenser 300.

With an implementation of the method 500, the multiple glazing units are fabricated. Therefore, the room installed with the multiple glazing units accomplished by the method 500 provides improved acoustic compared to single glazing units in the room. Moreover, the multiple glazing units are fabricated at the installation site. Additionally, the method 500 also provides an easy and quick way of applying the primary 108 and secondary sealant 110 at the installation site. The fixture 200 and dispenser 300 are portable and easy to handle.

Comparative Example 1

Secondary Sealant Wastage and Cost of the Dispenser

The Table 1 given below illustrates comparison of the secondary sealant wastage on the application of the secondary sealant in the clearance between the primary and secondary glazing unit and weight of the dispenser obtained according to the prior art 5167/CHE/2015 and according to the present disclosure.

It was evident that the prior art 5167/CHE/2015 focuses on a sealant applicator wherein the sealant is received at the thicker end which has less cross-section area and is dispensed out through the thinner end which has more cross-section area. On the contrary the present disclosure provides a dispenser 300 wherein the secondary sealant 110 is received at the proximal end 304 and is dispensed from the distal end 306. The cross-section area increases going away from proximal end 304 to distal end 306.

TABLE 1

| Comparative Sealant Wastage and Weight of the Dispenser | | | | | |
|---|---|---|---|---|---|
| | Weight of the | Length | Weight of the sealant (gm) | | Amount of |
| Dispenser | applicator (gm) | applied (cm) | Before Application | After Application | sealant consumed (gm) |
| Present Disclosure | 10 | 92 | 452.35 | 303.76 | 148.59 |
| 5167/CHE/2015 | 86 | 92 | 452.35 | 224.91 | 227.44 |

The weight of the dispenser 300 of the present disclosure is less as compared to the one disclosed in the prior art 5167/CHE/2015. As a result, less material is required to manufacture the dispenser 300 of the present disclosure as compared to the one disclosed in the prior art 5167/CHE/2015. Hence, the cost of manufacturing of the dispenser 300 of the present disclosure will be less. Further, the amount of secondary sealant 110 consumed is 1.5 times by the sealant applicator disclosed in the prior art 5167/CHE/2015 as compared to the dispenser 300 of the present disclosure.

Hence, the dispenser 300 of the present disclosure prevents leakage, minimizes wastage of the secondary sealant 110 and is lighter in weight. These all advantages put together make the dispenser 300 operator friendly in a practical and economical manner.

Comparative Example 2

Acoustic Comfort Studies

Two rooms of the same building were used to quantify the impact of multiple glazing unit using an extensive measurement campaign. The window of the first room was provided with a single glazing unit. The window of the second room was a triple glazing unit provided using the system 100 and method 500 of the present disclosure.

Figure 11:
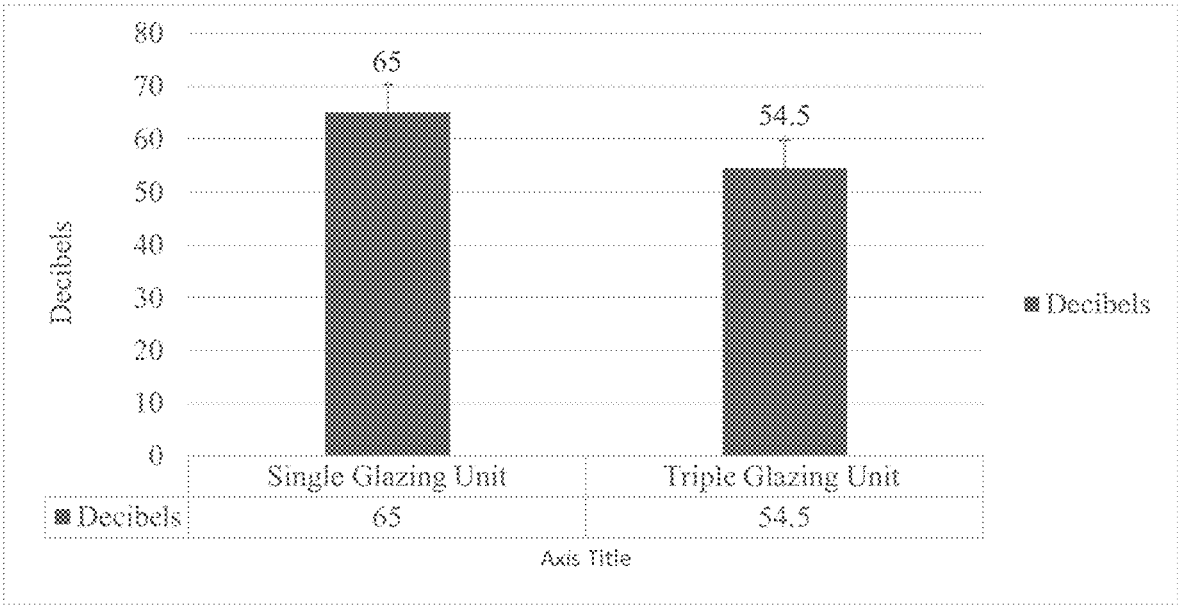
FIG. 11 illustrates a graph showing the intensity of sound recorded in rooms fitted with multiple glazing units by employing the installation system and method according to an embodiment of the present disclosure.

Acoustic measurements were taken for the two rooms. The results of the experiments are illustrated in FIG. 11.

A clear 10 decibels reduction was seen in a room provided with single glazing unit and the one provided with triple glazing unit using the system 100 and method 500 of the present disclosure. Thus the room with triple glazing unit using the system 100 and method 500 of the present disclosure showed improved acoustic comfort for all occupants in the room.

Note that not all the activities described above in the general description or the examples are required, that a portion of a specific activity may not be required, and that one or further activities may be performed in addition to those described. Still, further, the order in which activities are listed is not necessarily the order in which they are performed.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Certain features, that are for clarity, described herein in the context of separate embodiments, may also be provided in combination in a single embodiment. Conversely, various features that are, for brevity, described in the context of a single embodiment, may also be provided separately or in a sub combination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

The description in combination with the figures is provided to assist in understanding the teachings disclosed herein, is provided to assist in describing the teachings, and should not be interpreted as a limitation on the scope or applicability of the teachings. However, other teachings can certainly be used in this application.

As used herein, the terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the disclosure. This description should be read to include one or at least one and the singular also includes the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this disclosure belongs. The materials, methods, and examples are illustrative only and not intended to be limiting. To the extent that certain details regarding specific materials and processing acts are not described, such details may include conventional approaches, which may be found in reference books and other sources within the manufacturing arts.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

LIST OF ELEMENTS

100 Installation System
102 Primary Glazing Unit
104 Secondary Glazing Unit
106 Spacer Element
106*a* First Surface
106*b* Second Surface
106*c* Inner Surface
106*d* Outer Surface
108 Primary Sealant
110 Secondary Sealant
112 Clearance
114 Window Frame
200 Fixture
202 Upper Surface
204 Lower Surface
206 Pair of Dovetail Joint Edges
208 Cavity Channel
300 Dispenser
302 Hollow Tubular Member
304 Proximal end
306 Distal end
308 First Hole
310 Attachment Member
312 Second Hole
314 Pair of Wings
316 Pair of Parallel Long Edges
318 Pair of Parallel Short Edges
400 Cartridge
402 Nozzle
500 Method

What is claimed is:

1. An installation system for fabricating multiple glazing units at an installation site, the installation system comprising:

at least a primary glazing unit;

at least a secondary glazing unit;

a spacer element aligned there between at the periphery of the primary and secondary glazing unit, wherein the spacer element comprising a first surface and a second surface, the second surface is opposite to the first surface, the first surface is configured to be attached to the primary glazing unit and the second surface is configured to be attached to the secondary glazing unit;

a primary sealant;

a fixture to apply the primary sealant simultaneously on the first surface and the second surface of the spacer element, the fixture comprising:

an upper surface and a lower surface opposite to the upper surface, wherein the upper surface is coated with a hydrophobic material and the lower surface is flat and wherein the upper surface defines a cavity channel to receive and maintain the spacer element in a desired position for application of the primary sealant;

a secondary sealant; and a dispenser for applying the secondary sealant in a clearance between the primary glazing unit and the secondary glazing unit, the dispenser comprising:

a hollow tubular member having a proximal end and a distal end opposite the proximal end, the proximal end defining a first hole and an attachment member and the distal end defining a second hole and a pair of wings, wherein the attachment member is configured to attach to a nozzle of the sealant containing cartridge and wherein the first hole receives the secondary sealant and the second hole dispenses the secondary sealant to adjoin the primary and the secondary glazing unit, and the pair of wings finishes and smoothens the secondary sealant in the clearance between the primary glazing unit and the secondary glazing unit.

2. The installation system as claimed in claim 1, wherein the hydrophobic material includes one of silicon oil, grease, wax or machine oil.

3. The installation system as claimed in claim 1, wherein the cavity channel of the fixture has a depth not greater than the width of the spacer element.

4. The installation system as claimed in claim 1, wherein the hollow tubular member of the dispenser defines an internal passageway which is in a fluid communication with the first hole and the second hole.

5. The installation system as claimed in claim 1, wherein the hollow tubular member of the dispenser gradually tapers from a relatively large volume at the proximal end to a small volume at the distal end.

6. The installation system as claimed in claim 1, wherein the hollow tubular member of the dispenser has a defined length with a cross-section that increases in cross-sectional area going away from the proximal end to the distal end.

7. The installation system as claimed in claim 6, wherein the cross-section of the hollow tubular member of the dispenser varies from a circular cross-section at the proximal end to a rectangular cross-section at the distal end 6.

8. The installation system as claimed in claim 1, wherein the attachment member of the dispenser at the proximal end can be threaded or snap fit.

9. The installation system as claimed in claim 1, wherein the attachment member of the dispenser is configured to mate with the nozzle of the sealant containing cartridge.

10. The installation system as claimed in claim 1, wherein the distal end of the dispenser is nonplanar with the proximal end 304 and are configured to be at an angle 10° to 50° from the proximal end.

11. The installation system as claimed in claim 1, wherein each of the pair of wings at the distal end of the dispenser extend laterally from the second hole.

12. The installation system as claimed in claim 1, wherein the second hole of the dispenser is defined by a pair of parallel long edges and a pair of parallel short edges.

13. The installation system as claimed in claim 1, wherein the pair of wings of the dispenser are disposed in a plane parallel to the pair of short edges.

14. The installation system as claimed in claim 1, optionally comprises a tool for supplying the secondary sealant to the first hole of the dispenser.

15. The installation system as claimed in claim 1, wherein the spacer element is made of one of an aluminum or a poly-carbonate based material.

16. The installation system as claimed in claim 15, wherein the tool is an electrically pressurized tool or a pneumatically pressurized tool.

17. The installation system as claimed in claim 1, wherein the spacer element optionally consists of a moisture barrier disposed thereon and a hygroscopic material contained therein.

18. The installation system as claimed in claim 17, wherein the moisture barrier is an aluminum foil.

19. The installation system as claimed in claim 1, wherein the primary sealant includes one of an acrylic foam, a butyl coated poly-vinyl chloride or a poly-isobutyl.

20. The installation system as claimed in claim 1, wherein the secondary sealant includes a silicon based material.

21. The installation system as claimed in claim 1, wherein the multiple glazing unit exhibits improved acoustic property.

22. A method to fabricate multiple glazing units at the installation site, the method comprising:

providing at least a primary glazing unit, at least a secondary glazing unit, and a spacer element, wherein the spacer element has a first surface and a second surface opposite to the first surface;

applying a primary sealant simultaneously on the first surface and the second surface of the spacer element using a fixture;

attaching the first surface of the spacer element to the primary glazing unit;

attaching the second surface of the spacer element to the secondary glazing unit;

aligning the primary glazing unit in a substantially parallel relationship to the secondary glazing unit with the spacer element disposed there between at the periphery of the primary and the secondary glazing units; and filling a secondary sealant in a clearance between the primary glazing unit and the secondary glazing unit to adjoin the secondary glazing unit and the primary glazing unit using a dispenser.

* * * * *